US007347189B2

(12) United States Patent
Anello et al.

(10) Patent No.: US 7,347,189 B2
(45) Date of Patent: Mar. 25, 2008

(54) FUEL INJECTOR CLAMP WITH RETAINING SLEEVE

(75) Inventors: Anthony M. Anello, Bartlett, IL (US); Daniel W. Jensen, Elmhurst, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 540 days.

(21) Appl. No.: 10/368,725

(22) Filed: Feb. 19, 2003

(65) Prior Publication Data

US 2004/0159311 A1 Aug. 19, 2004

(51) Int. Cl.
*F02M 37/04* (2006.01)

(52) U.S. Cl. ..... 123/470; 123/509; 411/353; 411/43

(58) Field of Classification Search ..... 123/470, 123/472, 469, 468, 509, 495; 411/43, 34, 411/55, 437, 284, 999, 969, 353, 107, 541, 411/533, 539, 352; 72/391.6; 29/517
See application file for complete search history.

(56) References Cited

U.S. PATENT DOCUMENTS 3,221,794 A * 12/1965 Acres ..... 411/353
3,503,431 A * 3/1970 Whiteside et al. ..... 411/353
3,638,980 A * 2/1972 Kleinhenn ..... 411/320
4,012,984 A * 3/1977 Matuschek ..... 411/34
4,019,824 A * 4/1977 Percy ..... 403/261
4,203,402 A * 5/1980 Freyn ..... 123/470
4,206,725 A * 6/1980 Jenkel et al. ..... 123/470
4,250,733 A * 2/1981 Ruhl et al. ..... 29/243.529
4,435,112 A * 3/1984 Becker ..... 411/368
4,478,546 A * 10/1984 Mercer ..... 411/385
4,609,317 A * 9/1986 Dixon et al. ..... 411/339
4,768,908 A * 9/1988 Fauchet ..... 411/283
4,867,625 A * 9/1989 Dixon ..... 411/361
4,919,581 A * 4/1990 Dubech ..... 411/353
5,219,255 A * 6/1993 Hussain et al. ..... 411/432
5,393,183 A * 2/1995 Hinton ..... 411/432
5,437,550 A * 8/1995 Beaty et al. ..... 433/141
5,639,113 A * 6/1997 Goss et al. ..... 280/728.2
5,899,190 A * 5/1999 Nakagomi et al. ..... 123/470
5,934,254 A * 8/1999 Vetters et al. ..... 123/470
6,126,205 A * 10/2000 Schulz et al. ..... 285/18
6,170,467 B1 * 1/2001 Girard ..... 123/470
6,196,194 B1 * 3/2001 Mitchell ..... 123/470
6,367,813 B1 * 4/2002 Braun et al. ..... 277/630
6,431,152 B1 8/2002 Estacio
6,467,990 B1 * 10/2002 Kremsler et al. ..... 403/408.1
6,676,347 B2 * 1/2004 Jensen ..... 411/43
6,698,081 B2 * 3/2004 Oates et al. ..... 29/512
6,698,985 B2 * 3/2004 Gort ..... 411/261

* cited by examiner

*Primary Examiner*—Carl S. Miller
(74) *Attorney, Agent, or Firm*—Jeffrey P. Calfa; Gerald W. Askew

(57) ABSTRACT

The following describes an apparatus for and method of clamping a device, such as a fuel injector, to a platform, such as a cylinder head, and thereafter removing the device from the platform together with the clamp. A retaining sleeve is deformed such that the retaining sleeve is held in place between the clamp and a ledge on a fastener disposed within the clamp. The retaining sleeve secures the fastener to the clamp during removal of the fastener, thereby providing that the clamp assembly and the device, such as a fuel injector, are removed together.

19 Claims, 2 Drawing Sheets

FUEL INJECTOR CLAMP WITH RETAINING SLEEVE

FIELD OF THE INVENTION

This invention relates to fuel injector assemblies on cylinder heads in internal combustion engines, including but not limited to injector clamps that fasten fuel injectors to the cylinder head.

BACKGROUND OF THE INVENTION

The assembly of fuel injectors onto a cylinder head and the use of hold down clamps to secure the injector into the cylinder head are well known. Existing devices used to hold down or secure fuel injectors to cylinder heads are often impractical because such devices tend to be bulky, thereby adding to the crowding of components in the limited space on a cylinder head. Also, during disassembly or removal of the fuel injector from the cylinder head, the use of previous clamps typically requires that a tool pries the fuel injector from the cylinder head. Prying the fuel injector from the cylinder head frequently results in a damaged injector. Further, because the space around the fuel injector on the cylinder head is very limited, difficulty is encountered in prying the fuel injector from the cylinder head.

U.S. Pat. No. 6,431,152 titled "Injector Hold Down Clamp" describes a compact clamp assembly that allows for disassembly of a fuel injector from a cylinder head without the need to pry the fuel injector from the cylinder head. This patent describes the use of a bolt with a clamp and a retainer ring that holds the bolt to the clamp during injector removal. Nevertheless, the retainer ring could separate from the bolt, resulting in the need to manually pry the fuel injector from the cylinder head.

Accordingly, there is a need for an injector hold down clamp that provides for removal of the fuel injector from the cylinder head without the need to pry the fuel injector from the cylinder head and providing enhanced retention of the bolt in the clamp.

SUMMARY OF THE INVENTION

An apparatus includes a clamp for use with a device, such as a fuel injector, disposed with a platform, such as a cylinder head. The clamp has a passage. A fastener is disposed within the passage of the clamp and has recess bounded by a ledge. A retaining sleeve is at least partially deformed. The deformed retaining sleeve is secured between the clamp and the ledge when the fastener is removed from the platform, such as a cylinder head, to thereby allow the apparatus to be removed together with the device, such as a fuel injector.

DESCRIPTION OF A PREFERRED EMBODIMENT

The following describes an apparatus for and method of clamping a device, such as a fuel injector, to a platform, such as a cylinder head, and thereafter removing the device from the platform together with the clamp. A retaining sleeve is deformed such that the retaining sleeve is held in place between the clamp and a ledge on a fastener disposed within the clamp. The retaining sleeve secures the fastener to the clamp during removal of the fastener, thereby providing that the clamp assembly and the device, such as a fuel injector, are removed together.

Figure 1:
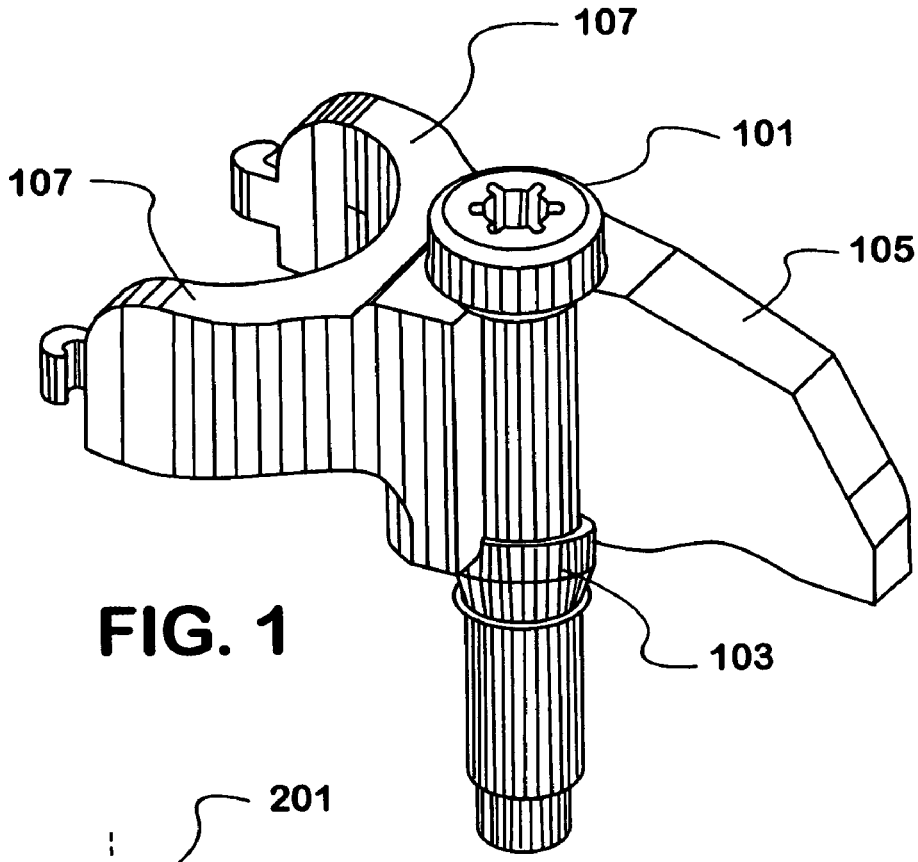
FIG. 1 is a perspective view of an injector clamp with a cutaway view of a fastener and an interior surface of the injector clamp in accordance with the invention.

A perspective view of an injector clamp with a cutaway view of a fastener and an interior surface of the injector clamp is shown in FIG. 1. A fastener 101, such as a threaded bolt, stud bolt, screw, and so forth, is secured by a deformed retaining sleeve 103, such as a compressed cylindrical sleeve, to a clamp 105. The clamp 105 has one or more mounting devices 107 that attach to a fuel injector such that the clamp 105 and the fuel injector are mountable to a cylinder head of an internal combustion engine via the fastener 101.

Figure 2:
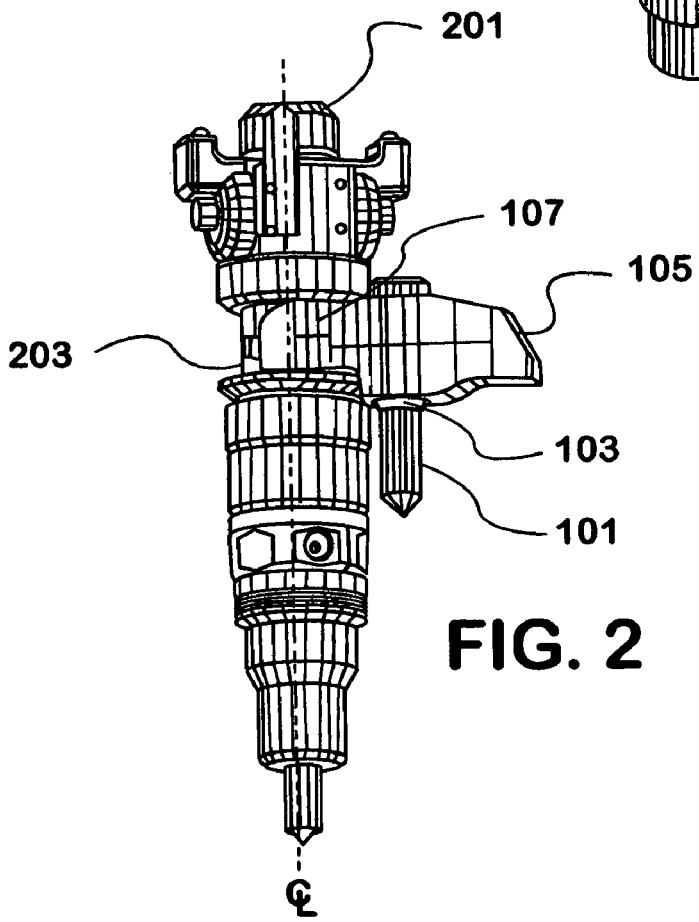
FIG. 2 is a perspective view of an injector clamp assembly disposed on a fuel injector in accordance with the invention.

A perspective view of an injector clamp assembly disposed on a fuel injector 201 is shown in FIG. 2. The mounting device 107 comprises a pair of arms that fit within a slot 203 of the fuel injector 201 to secure the clamp 105 to the fuel injector 201. The injector clamp assembly may be utilized in internal combustion engines, such as gas or diesel engines or in-line or V-type cylinder configurations or rotary or turbine engines, and so forth. A diagram illustrating the attachment of the injector clamp assembly with an injector 201 to an engine is shown in FIG. 3 of U.S. Pat. No. 6,431,152, the entirety of which is incorporated herein by reference.

Figure 3A:
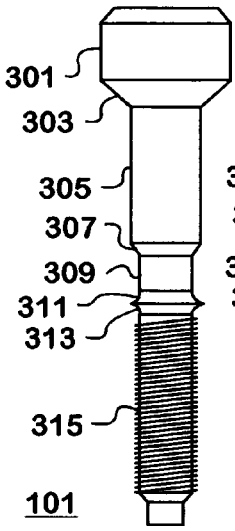
FIG. 3A and FIG. 3B are side views of various embodiments of the fastener for the injector clamp in accordance with the invention.
Figure 3B:
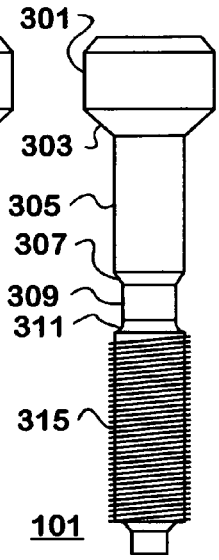

Side views of various embodiments of the fastener for the injector clamp are shown in FIG. 3A and FIG. 3B. The fastener 101 is advantageously a bolt or screw that is threaded to more securely hold the clamp 105 and fuel injector to the cylinder head. The fastener 101 has a head 301 with a slot (shown in FIG. 1) shaped to mate with a driver bit that is used to fasten the fastener to the cylinder head. A neck 303 tapers from the head 301 to a cylindrical segment 305. A recess in the fastener 101 is characterized by a section 307 that tapers to a cylindrical section 309 that is bounded by a ledge 311. A successful embodiment of the invention may be provided with numerous different shapes of the various sections 307, 309, and 311 of the recess. In FIG. 3A, the ledge 311 has a necked-down region 313 that tapers to a threaded section 315 near one end of the fastener 101. The fastener 101 of FIG. 3A may be produced, for example, from a bolt that has a shaft that is wider near the neck 303 than in the threaded section. In FIG. 3B, the threaded section 315 of the fastener extends immediately below the ledge 311. A lip may form near the edge from the process of adding the recess in the fastener.

The fastener 101 may generally be manufactured utilizing the following process. The fastener 101 is cold rolled. A blanking process provides the shape of the head 301, the neck 303, the cylindrical segment 305 extended at the diameter of the cylindrical segment 305 down to the section where the ledge 311 is to be formed, and a necked-down region 313 that that tapers down to the pitch diameter of the threaded region 315. It is advantageous to locate the ledge 311 as far from the head 301 as possible, while maintaining the threads 315 as close to the head 301 as possible. A channel is rolled into the fastener 101 just above the necked-down region 313, resulting in formation of the tapering section 307, the cylindrical section 309, and the ledge 311. If the fastener 101 elongates when the channel is rolled, such elongation needs to be compensated for when locating the necked-down region 313 in the blanking operation. The displacement of material from the rolling process yields the ledge 311 that borders the channel in which the retaining sleeve 403 engages. After the channel is formed, threads are rolled up as high as possible without interfering with the channel or ledge 311. Optionally, the cylindrical section 309 may extend from the ledge 311 to the neck 303, thus replacing sections 305 and 307. Other manufacturing processes may also be utilized.

The clamp 105 is advantageously comprised of cast metal that is quenched and tempered to Rc 45-55 standards, while the fastener 101 is advantageously comprised of class 12.9 phosphate coated metal. One of skill in the art readily recognizes that other types of materials may be utilized as long as the clamp 105 and fastener 101 secure the injector to the cylinder head while adequately withstanding any forces encountered during operation of the engine.

Figure 4A:
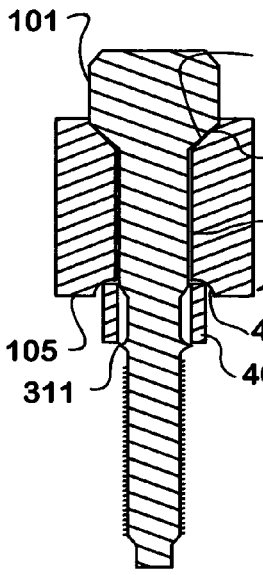
FIG. 4A and FIG. 4B are cross-sectional views of the fastener disposed within the injector clamp in accordance with the invention.
Figure 4B:
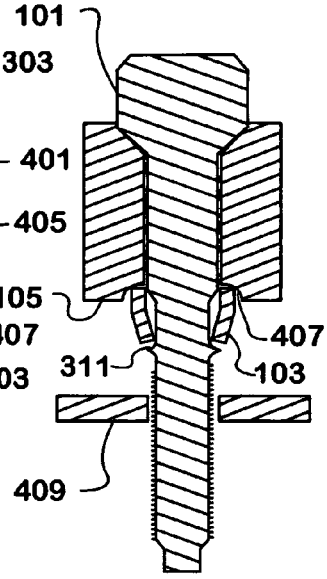

Cross-sectional views of the fastener 101 disposed within the clamp 105 are shown in FIGS. 4A and 4B. The internal passage of the clamp 105 is characterized by a conical surface 401 at a first end of the passage, a cylindrical surface 405, and an extending surface 407 at the second end of the passage. The extending surface 407 extends, e.g., tapers, away from cylindrical surface 405 in any number of shapes including conical, curved, flat, stepped or flush. When the fastener 101 is placed in the passage of the clamp 105 as shown, the neck 303 of the fastener 101 abuts against the conical surface 401, thereby preventing the fastener 101 from continuing completely through the passage. A retaining sleeve 403 is shown disposed near the clamp 105.

As shown in FIG. 4B, the retaining sleeve 103 is at least partially deformed such at least a part of the at least partially deformed retaining sleeve occupies at least a part of the recess. When the fastener 101 is removed from the cylinder head, the deformed retaining sleeve 103 is secured between the extending surface 407 and the ledge 311, thereby securing the fastener 101 to the clamp 105. By securing the deformed retaining sleeve 103 between the extending surface 407 and the ledge 311, there are horizontal and vertical components to the normal forces acting on the deformed retaining sleeve 103, resulting in a more secure entrapment of the retaining sleeve 103. As a result, while the fastener 101 is removed from the cylinder head, the fastener 101 remains secured to the clamp 105, which in turn is coupled to the fuel injector 201. Thus, the clamp assembly 101, 103, and 105 and the fuel injector 201 are collectively removed from the cylinder head. The fastener 101 and clamp 105 are shown partially disposed with a platform 409, such as a cylinder head.

Figure 5:
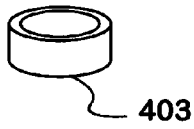
FIG. 5 is a perspective view of a retaining sleeve in accordance with the invention.

A perspective view of a retaining sleeve 403 is shown in FIG. 5. The retaining sleeve 403 is advantageously comprised of, for example, 12-gauge low carbon steel, although different materials and/or different sizes may be utilized depending on the application. When deformed, the lower end of the deformed retaining sleeve 103 has an inner diameter that is less than the outer diameter of the ledge 311, thus the deformed retaining sleeve 103 is securely trapped between the clamp 105 and the ledge 311. Further, when the retaining sleeve 403 is a cylindrical sleeve that extends 360 degrees and is advantageously unbroken, once the retaining sleeve 403 is deformed, dislodging the sleeve is extremely difficult. Objects external to the clamp 105 are unlikely to dislocate the deformed retaining sleeve 103. Engine operation and/or vibration are also unlikely to dislodge the deformed retaining sleeve 103.

Figure 6:
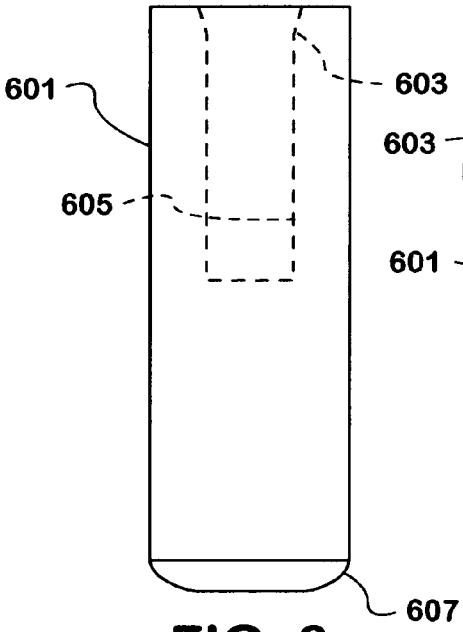
FIG. 6 is a side view of a deformation tool utilized to deform the retaining sleeve onto the fastener in accordance with the invention.
Figure 7:
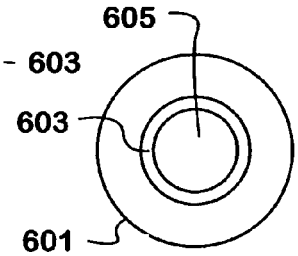
FIG. 7 is a top view of the deformation tool in accordance with the invention.

A side view of a deformation tool utilized to deform the retaining sleeve onto the fastener is shown in FIG. 6. The deformation tool 601 is a solid device comprised of a very hard material, such as, for example, 4140 Rc 50+ steel, that has a cavity at one end. The cavity is comprised of a tapered section 603 and a cylindrical section 605. The other end 607 is utilized for striking the tool. FIG. 7 illustrates a top view of the deformation tool.

Figure 8:
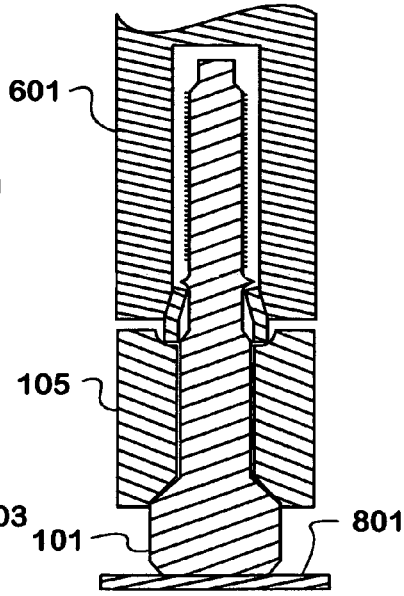
FIG. 8 is a cross-sectional view of the deformation tool in conjunction with the retaining sleeve as positioned on the fastener in accordance with the invention.

A cross-sectional view of the deformation tool in conjunction with the retaining sleeve as positioned on the fastener is shown in FIG. 8. At least the threaded section 315 of the fastener 101 and at least a part of the retaining sleeve 403 fit within the cavity of the deformation tool 601. Once the deformation tool 601 is placed over the clamp assembly, the head 301 of the fastener 101 is placed on a surface 801 and the end 607 of the deformation tool 601 is struck with a force significant enough to deform the retaining sleeve 403 such that at least a part of the retaining sleeve is deformed, e.g., by compression. The end 607 of the deformation tool 601 may be struck by a hydraulic ram or an appropriate hammer. The deformed retaining sleeve 103, as shown, has a component that resides within the recess of the fastener 101. The deformed retaining sleeve 103 secures the fastener 101 to the clamp 105, such that the clamp assembly 101, 103, and 105 and the injector 201 are removed together when the fastener 101 is removed, e.g., unscrewed, from the cylinder head. When the retaining sleeve 403 is advantageously deformed such that the entire lower edge of the deformed retaining sleeve 103 has an inner diameter that at all times is smaller than the smallest outer diameter of the ledge 311, the deformed retaining sleeve 103 is most securely held. Thus, the chances of the retaining sleeve 103 coming loose from the assembly are remote.

Although the present invention is described above with respect to a fuel injector fastened to a cylinder head, it is possible to utilize the clamp and fastener approach to devices other than a fuel injector and to devices fastened to platforms other than a cylinder head. Thus, the present invention provides a method and apparatus for removing the clamp and device together from the platform.

The present invention provides a method and apparatus for fastening a fuel injector clamp to a cylinder head while providing that the clamp is removed from the cylinder head together with the fuel injector. A retaining sleeve is secured between an extending surface of the clamp and a ledge of a fastener within a passage of the clamp to retain the clamp with the fastener as the fastener is removed. The deformed retaining sleeve is continuous, thereby preventing external objects from dislodging the retaining sleeve. The arrangement utilized to secure the retaining sleeve is more robust, thus separation of the retaining sleeve from the fastener is less likely. If the retaining sleeve should somehow become dislodged from the fastener, the retaining sleeve is too large to fit through the oil intake grate. A deformation tool is also provided to compress at least a part of the retaining sleeve onto the fastener without damaging the threads on the fastener.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a clamp for use with a fuel injector disposed in a cylinder head, the clamp having a passage;

a fastener disposed within the passage of the clamp and having a recess bounded by a ledge, and a threaded shank for threaded engagement with the cylinder head;

a retaining sleeve that is at least partially deformed to a shape that includes a non-deformed base end part having an inside diameter greater than both an outside diameter of the ledge and an outside diameter of the threaded shank and a contiguous deformed distal end part that undergoes plastic deformation to have an inside diameter less than the diameter of the ledge, wherein the deformed retaining sleeve is secured between the clamp and the ledge to thereby allow the apparatus to be removed together with the fuel injector when the fastener is removed from the cylinder head.

2. The apparatus of claim 1, wherein the retaining sleeve is at least partially compressed such that at least a part of the at least partially compressed retaining sleeve occupies at least part of the recess.

3. The apparatus of claim 1, wherein the retaining sleeve is a cylindrical sleeve that extends 360 degrees.

4. The apparatus of claim 1, further comprising a deformation tool, arranged and constructed to at least partially compress the retaining sleeve when the deformation tool is struck.

5. The apparatus of claim 4, wherein the deformation tool comprises a hollow cavity capable of enclosing at least a part of the fastener and a part of the retaining sleeve.

6. An apparatus comprising:

a fastener having a recess disposed adjacent to a ledge, and a threaded shank for threaded engagement with a cylinder head of an internal combustion engine;

a cylindrical retaining sleeve disposed at least partially within the recess, wherein the retaining sleeve extends 360 degrees;

a clamp comprising:

a securing device capable of securing a fuel injector within the cylinder head of the internal combustion engine; and a passage characterized at least in part by a cylindrical surface and an extending surface extending away from the cylindrical surface such that the retaining sleeve is secured between the extending surface and the ledge to thereby allow the apparatus and the fuel injector to be removed together from the cylinder head;

wherein the retaining sleeve is at least partially deformed such that a portion of an inside surface of the sleeve is deformed from a cylindrical shape to a shape that is at least partially frusto-conical.

7. The apparatus of claim 6, wherein the retaining sleeve is at least partially compressed such that at least a part of the at least partially compressed retaining sleeve occupies at least a part of the recess.

8. The apparatus of claim 6, wherein the deformed retaining sleeve has a lower inner diameter that is smaller than an outer diameter of the ledge.

9. The apparatus of claim 6, further comprising a deformation tool, arranged and constructed to at least partially compress the retaining sleeve when the deformation tool is struck.

10. The apparatus of claim 9, wherein the deformation tool comprises a hollow cavity capable of enclosing at least a part of the fastener and a part of the retaining sleeve.

11. A method comprising the steps of:

inserting a fastener in a first end of a passage of a clamp such that a plurality of threads near a first end the fastener passes through a second end of the passage of the clamp, wherein the clamp is capable of clamping a fuel injector to a cylinder head when the fastener is fastened to the cylinder head by threaded engagement of said plurality of threads;

providing a retaining sleeve that has an un-stretched inside diameter greater than an outside diameter of said plurality of threads such that the sleeve can slide freely over the plurality of threads without deforming said sleeve;

inserting the first end of the fastener through a retaining sleeve;

sliding the retaining sleeve over and past the plurality of threads until the retaining sleeve is substantially adjacent to the second end of the passage of the clamp;

deforming the retaining sleeve such that the deformed retaining sleeve is secured between the clamp and a ledge on the fastener.

12. The method of claim 11, wherein the step of deforming comprises compressing at least a segment of the retaining sleeve such that at least a pad of the retaining sleeve is disposed within a recess of the fastener.

13. The method of claim 11, wherein the step of deforming comprises sliding a deformation tool over the first end of the fastener until the deformation tool is at least partially adjacent to the retaining sleeve and striking the deformation tool to thereby compress the retaining sleeve such that at least a part of the retaining sleeve occupies at least a part of a recess adjacent to the ledge.

14. The method of claim 11 further comprising the steps of:

coupling the clamp to a fuel injector;

fastening the fastener to a cylinder head while positioning the fuel injector into a position in the cylinder head.

15. The method of claim 11, further comprising the step of unfastening the fastener from the cylinder head, thereby collectively removing the fastener, the clamp, the retaining sleeve, and the fuel injector from the cylinder head.

16. An apparatus comprising:

a clamp capable of clamping a device to a platform, the clamp having a passage;

a fastener disposed within the passage of the clamp and having a recess bounded by a ledge, and a threaded shank, wherein the fastener is capable of being fastened to the platform by the threaded shank;

a retaining sleeve that is at least partially deformed to a shape that includes a non-deformed base end part having an inside diameter greater than both an outside diameter of the ledge and an outside diameter of the threaded shank and a contiguous deformed distal end part that undergoes plastic deformation to have an inside diameter less than the diameter of the ledge, wherein the deformed retaining sleeve is secured between the clamp and the ledge to thereby allow the apparatus to be removed together with the device when the fastener is removed from the platform.

17. The apparatus of claim 16, wherein the ledge acts on the deformed retaining sleeve to retain the deformed retaining sleeve with the clamp.

18. The apparatus of claim 1, wherein the deformed retaining sleeve is secured between the clamp and the ledge without requiring a device external to the retaining sleeve to retain the retaining sleeve with the clamp.

19. The apparatus of claim 6, wherein once the retaining sleeve is at least partially deformed, dislodging the retaining sleeve from the fastener requires plastic deformation of the retaining sleeve.

* * * * *